US006227988B1

(12) United States Patent
Bodman

(10) Patent No.: US 6,227,988 B1
(45) Date of Patent: May 8, 2001

(54) BATTING PRACTICE TRAINING DEVICE

(76) Inventor: Joseph A Bodman, 700 Riverside Harbor Dr. W., Post Falls, ID (US) 83854

( * ) Notice: Subject to any disclaimer, the term of this patent is extended or adjusted under 35 U.S.C. 154(b) by 0 days.

(21) Appl. No.: 09/414,921

(22) Filed: Oct. 12, 1999

(51) Int. Cl.[7] ..... A63B 69/00
(52) U.S. Cl. ..... 473/424; 473/422
(58) Field of Search ..... 473/420–429, 473/FOR 102, 103, 104, 108–109

(56) References Cited

U.S. PATENT DOCUMENTS

| | | | | |
|---|---|---|---|---|
| 2,942,883 | * | 6/1960 | Moore | 473/424 |
| 3,731,925 | * | 5/1973 | Caldwell | 473/424 |
| 3,907,287 | * | 9/1975 | Fox et al. | 473/424 |
| 4,415,155 | | 11/1983 | Goudreau et al. . | |
| 4,565,367 | * | 1/1986 | Kaiser | 482/131 |
| 4,577,864 | * | 3/1986 | Aldrich | 473/424 |
| 5,458,327 | | 10/1995 | Crespin . | |
| 5,597,159 | * | 1/1997 | Haygood et al. | 473/424 |
| 5,709,619 | * | 1/1998 | D'Emidio | 473/424 |

* cited by examiner

*Primary Examiner*—Stephen F. Gerrity
*Assistant Examiner*—Mitra Aryanpour
(74) *Attorney, Agent, or Firm*—David S. Thompson

(57) ABSTRACT

A batting practice training device includes a handle which contains a bearing attached to the proximal end of a rope. The distal end of the rope is attached to a ball. A retaining strap is attached to each end of the handle, and wraps about the back of the hand of the pitcher, helping to prevent release of the handle by the pitcher. In one embodiment of the invention, the handle is wedge-shaped, with the smaller end attached to the rope. The wedge shape tends aids the pitcher to retain possession of the handle after the ball is hit by the batter. In use, the pitcher swings the ball in a generally circular orbit, causing it to pass through the strike zone of the batter, who hits the ball.

2 Claims, 2 Drawing Sheets

BATTING PRACTICE TRAINING DEVICE

CROSS-REFERENCES

There are no applications related to this application filed in this or any foreign country.

BACKGROUND

A number of complex and expensive pitching machines are well-known and used by professional players in the course of batting practice. Use of such a machine provides economical practice without the expense of having a qualified pitcher available. Unfortunately, while such pitching machines and associated batting cages are economical for major league and some minor league teams, they are prohibitively expensive for use by children and recreational teams.

Inspired by the expense of the above devices, the use of a tethered ball has become known. Tethering a ball allows that ball to be swung in a circular path which may be adjusted to pass through the batter's strike zone.

U.S. Pat. No. 5,458,327 issued in 1995 to Crespin discloses the use of a ball on the distal end of a rope having its proximal end attached to the distal end of a dowel. By manual manipulation of the proximal end of the dowel, the ball on the end of the rope may be moved through the batter's strike zone.

In spite of the above device, there is a need for a batting practice training device that can be easily, conveniently and accurately handled. The batting practice training device must be easily manipulated in a manner that allows the ball to be repetitively passed through the batter's strike zone, it must provide appropriate bearing surfaces to promote easy revolution of the rope in a manner that does not stress the hand, wrist or arm of the user, and it must provide enhanced gripping structures that contribute to relaxed operation by the pitcher.

SUMMARY

The present invention is directed to an apparatus that satisfies the above needs. A novel batting practice training device is disclosed that is easily manipulated in a manner that allows the ball to be repetitively passed through the batter's strike zone, provides appropriate bearing surfaces to promote easy revolution of the rope in a manner that does not stress the hand, wrist or arm of the pitcher, and provides enhanced gripping structures that contribute to relaxed operation by the pitcher.

The batting practice training device of the present invention provides some or all of the following structures.

(A) A handle 20 includes a generally cylindrical body, with a diameter sized for easy gripping by the pitcher. Finger grips 22 are defined on one side of the body. A cavity 23 within the body is sized to contain the bearing.

(B) A bearing 30 is carried within the cavity in the handle and allows the rope to rotate freely. By allowing the rope to rotate, the rope does not become twisted as the ball moves in its orbit.

(C) A retaining strap 40 is carried by the first and second ends of the handle. In use, the strap wraps about the back of the hand of the pitcher, and tends to prevent the handle from being pulled from the hand of the pitcher when the batter hits the ball.

(D) A proximal end of the rope 50 is attached to the bearing supported in the handle, while the distal end of the rope is fastened to the ball.

(E) A ball 60 may be either a baseball, softball or similar ball. The ball is attached to the distal end of the rope, allowing the ball to be swung in an orbit around the pitcher. In a preferred embodiment of the invention, a channel 61 is defined through the ball, allowing a knot in the distal end of the rope to fasten the rope to the ball.

It is therefore a primary advantage of the present invention to provide a novel batting practice training device that allows the pitcher to repeatedly cause the ball to pass through the batter's strike zone, thereby allowing the batter to practice hitting.

Another advantage of the present invention is to provide a novel batting practice training device that is inexpensive to manufacture and sell, which is durable and long-lasting and which will contribute in a noticeable manner to the skill of developing ball players.

Another advantage of the present invention is to provide a novel batting practice training device that includes a wedge-shaped handle, the shape of which tends to aid the user in resisting forces which might otherwise remove the handle from the hand.

A still further advantage of the present invention is to provide a novel batting practice training device that provides the bearing surfaces and safety retaining straps that reduce the possibility of injury due to repetitive motion or due to the ball flying after impact with the bat.

DRAWINGS

These and other features, aspects, and advantages of the present invention will become better understood with regard to the following description, appended claims, and accompanying drawings where:

DESCRIPTION

Figure 1:
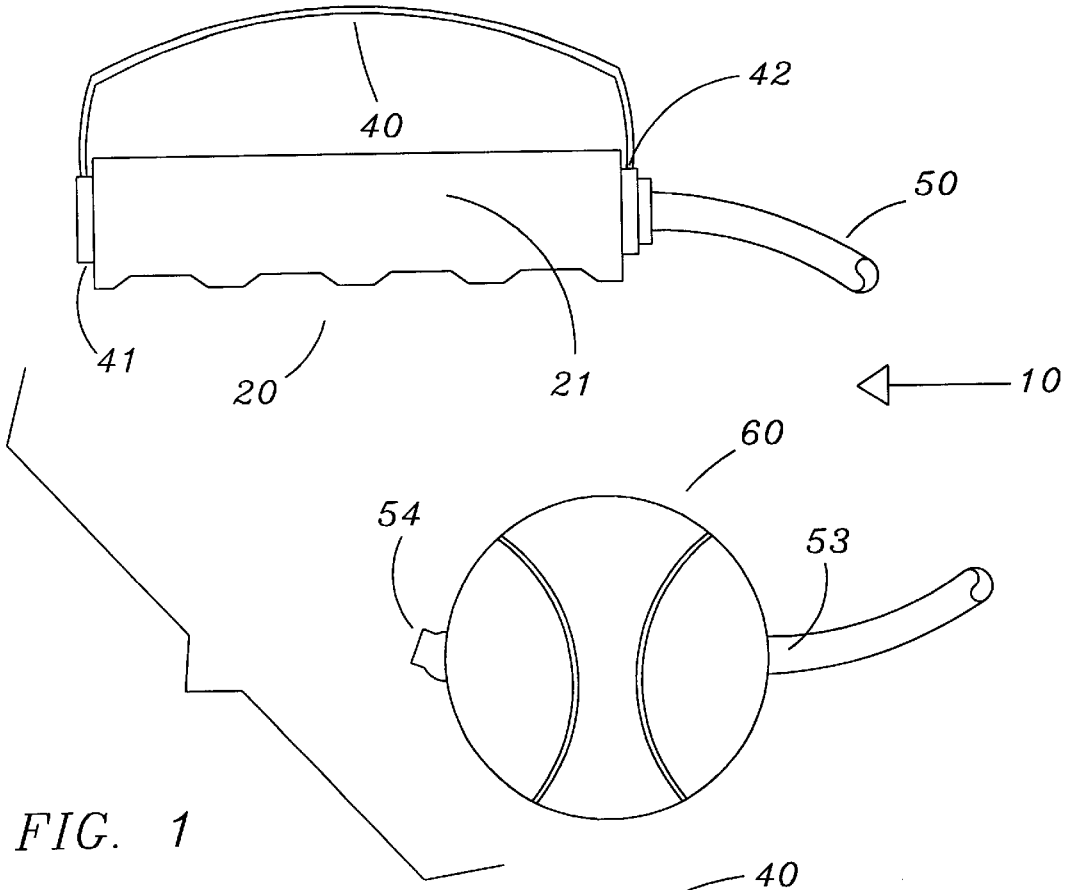
FIG. 1 is a side orthographic view of a version of the batting practice training device having a handle with a generally cylindrical body.

Referring in generally to FIGS. 1 through 4, a batting practice training device 10 constructed in accordance with the principles of the invention is seen. A handle 20 contains a bearing 30 attached to the proximal end of a rope 50. The distal end of the rope is attached to a ball 60. A retaining strap 40 is attached to each end of the handle, and wraps about the back of the hand of the pitcher, helping to prevent release of the handle by the pitcher. In one embodiment of the invention, the handle is wedge-shaped, with the smaller end attached to the rope. The wedge shape tends aids the pitcher to retain possession of the handle after the ball is hit by the batter. In use, the pitcher swings the ball in a generally circular orbit, causing it to pass through the strike zone of the batter, who hits the ball.

As seen in FIG. 1, a version of the handle 20 includes a generally cylindrical body 21, having a diameter sized for easy manual gripping by the pitcher. In a preferred embodiment, finger grips 22 are defined on the exterior surface of the body to resist the tendency for the handle to be pulled from the pitcher's hand if the batter hits the ball.

A cavity 23 defined within a first end 25 of the body is sized to contain the bearing 30. A groove 24 is sized to enclose the bearing race, and to thereby prevent movement of the bearing.

Figure 2:
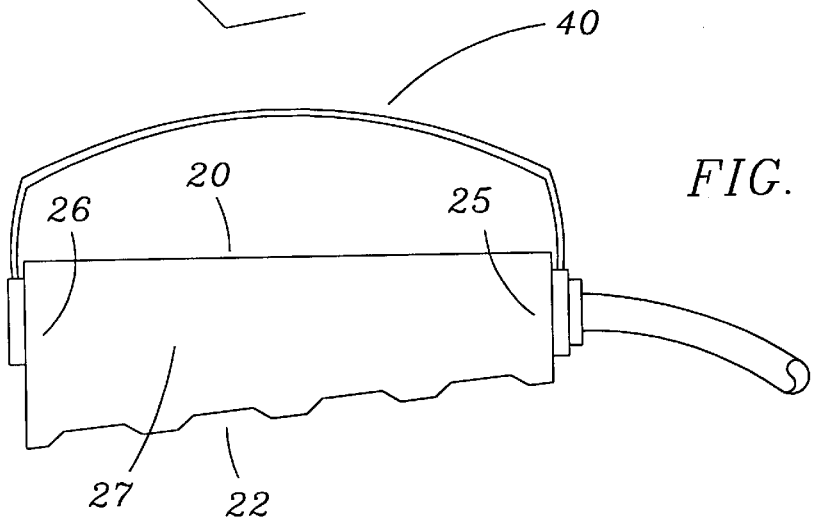
FIG. 2 is a side orthographic view of a second version of the invention, having a handle with a wedge-shaped body.

As seen in FIG. 2, a second version of the handle includes a wedge-shaped body 27. In this version of the handle, the first end 25 of the body 27 is smaller than the second end 26, resulting in the wedge shape. The wedge shape aids the pitcher in retaining possession of the handle after the ball has been hit.

A bearing 30 is carried within the cavity in the handle and promotes the free and nearly frictionless rotation of the rope. By providing a structure to promote the rotation of the rope, the rope does not become twisted as the ball moves in its orbit during operation. This also tends to reduce stress on the pitcher's arm and wrist, by eliminating the movements that would be required if the rope did not turn in a bearing.

Figure 4:
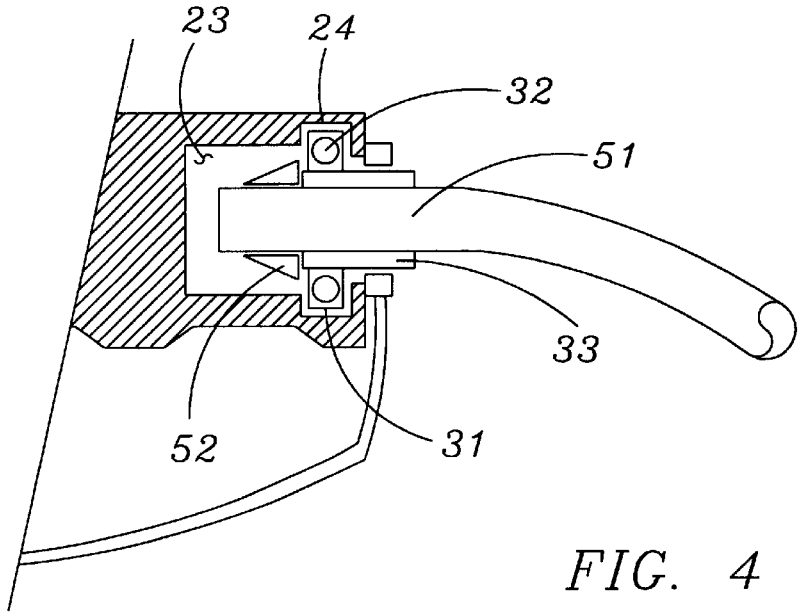
FIG. 4 is an enlarged cross-sectional view of the bearing, handle and proximal end of the rope.

As seen particularly in the enlarged view of FIG. 4, a preferred bearing 30 provides a ball bearing race 31 having a number of ball bearings 32 to reduce friction. The collar 33 defines an inside channel sized for passage of the proximal end 51 of the rope 50. In operation, the friction between the rope and collar is much greater than the friction between the collar and the bearing race; therefore the collar turns within the bearing race, and friction is eliminated between the rope and collar.

A retaining strap 40 is carried by the first and second ends 25, 26 of the handle. During use, the retaining strap wraps about the back of the hand of the pitcher, and tends to prevent the handle from being pulled from the hand of the pitcher when the batter hits the ball. As seen in the figures, the retaining strap is oriented in a manner which wraps about the back of the pitcher hand. In use, the retaining strap tends to prevent unwanted separation of the handle and the pitcher's hand.

A preferred strap is made of an elastic fabric material which resiliently elongates and deforms to frictionally engage and retain the pitcher's hand by providing a force which biases the pitcher's hand against the handle.

In a preferred embodiment, the strap 40 is supported from the first and second ends of the handle by a forward and a rear fastener 41, 42, which may be attached to the ends of the handle by known frictional, adhesive or locking structures.

A rope 50 is selected having an appropriate length to allow the pitcher to swing the ball 60 through the batter's strike zone, while still allowing the batter sufficient time to see the ball coming and to maintain eye contact. In a preferred embodiment, the rope is typically 8 to 12 feet long. However, a rope having a greater or lesser length could be substituted, particularly where older or younger children are being trained to bat.

The proximal end 51 of the rope 50 is attached to the bearing supported in the handle, while the distal end 53 of the rope is fastened to the ball. As seen in FIG. 4, the proximal end is passed through the collar of the bearing and is secured with a clinched fastener 52 or similar device. Such a fastener is sized to prevent passage of the end of the rope back through the collar of the bearing, and also to allow free rotation of the end of the rope and the clinch fastener within the bearing cavity of the handle.

Figure 3:
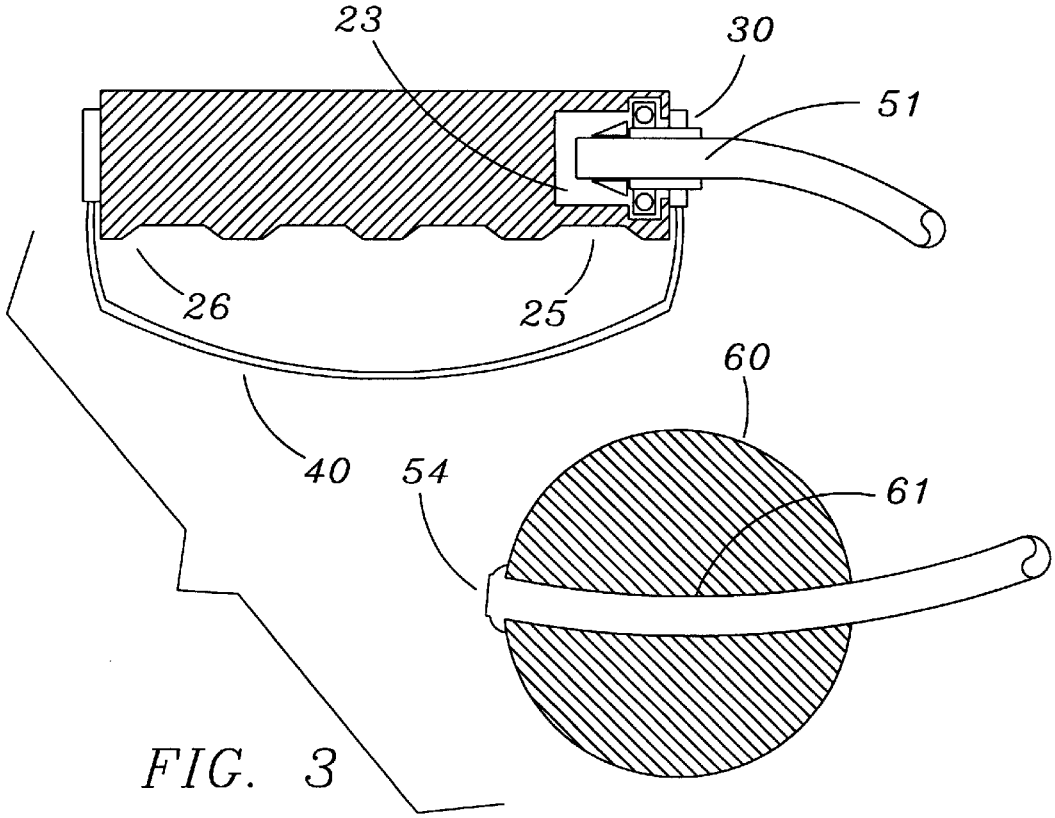
FIG. 3 is a cross-sectional view of the batting practice training device of FIG. 1.

A ball 60 is attached to the distal end 53 of the rope 50. The ball may be either a baseball, softball or similar ball. The ball is attached to the distal end of the rope, allowing the ball to be swung in an orbit around the pitcher. In a preferred embodiment of the invention, a channel 61 is defined through the ball, allowing the rope to be passed through the ball. The distal end of the rope is then fastened to the ball in a manner that resists separation. As seen in FIGS. 1 and 3, in a preferred embodiment, a knot 54 in the distal end 53 of the rope is used to fasten the rope to the ball. The size of the knot prevents its passage through the channel 61, and therefore secures the ball to the rope.

In operation, the pitcher puts the fingers of one hand through the retaining strap 40, stretching the retaining strap slightly, in a manner that will cause the strap to bias the pitcher's hand against the handle 20. The fingers of the hand are wrapped about the finger grips 22, allowing the pitcher to obtain a firm, yet comfortable, grip.

The pitcher then raises the handle over the head and moves it in a generally circular pattern, causing the ball to move in a circular orbit about the pitcher. The pitcher adjusts the orbit of the ball gradually, bringing it into a pattern resulting in passage through the batter's strike zone on each orbit.

The batter then uses a baseball or softball bat to swing at, and hit, the ball as it moves through the strike zone. Once hit, the ball tends to fly a short distance, but is prevented from distant travel by the rope and handle. After a hit, the handle generally stays attached to the pitcher's hand due to the finger grips 22 and the retaining strap 40. Where the handle provides the wedge-shaped body 27 seen in FIG. 2, the shape of the body may additionally aid the pitcher in retaining possession of the handle.

The previously described versions of the present invention have many advantages, including a primary advantage of providing a novel batting practice training device that allows the pitcher to repeatedly cause the ball to pass through the batter's strike zone, thereby allowing the batter to practice hitting.

Another advantage of the present invention is to provide a novel batting practice training device that is inexpensive to manufacture and sell, which is durable and long-lasting and which will contribute in a noticeable manner to the skill of developing ball players.

A still further advantage of the present invention is to provide a novel batting practice training device that provides the bearing surfaces and safety retaining straps that reduce the possibility of injury due to repetitive motion or due to the ball flying after impact with the bat.

Another advantage of the present invention is to provide a novel batting practice training device that includes a wedge-shaped handle, the shape of which tends to aid the user in resisting forces which might otherwise remove the handle from the hand.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A batting practice training device, comprising:

(A) a cylindrical handle having a diameter sized for easy manual gripping, the cylindrical handle having finger grips defined on an exterior surface and a cavity defined within the cylindrical handle;

(B) a retaining strap, carried by a first end and a second end of the cylindrical handle;

(C) a rope, having a proximal end and a distal end; and (D) a bearing, carried within the cavity defined within the cylindrical handle, the bearing comprising:

(a) a ball bearing race, carried within a groove defined in the handle;

(b) a collar, carried by the proximal end of the rope;

(c) a clinch fastener, carried by the rope, adjacent to, and proximal of, the collar, for preventing the rope from disengaging from the collar; and (d) a plurality of ball bearings, carried within the ball bearing race in contact with the collar, whereby rotation of the collar is facilitated by the ball bearings; and (E) a ball, attached to the distal end of the rope.

2. A batting practice training device, comprising:

(A) a wedge-shaped handle sized for easy manual gripping, the wedge-shaped handle having finger grips defined on an exterior surface and a cavity defined within the wedge-shaped handle;

(B) a retaining strap, carried by a first end and a second end of the wedge-shaped handle;

(C) a rope, having a proximal end and a distal end; and (D) a bearing, carried within the cavity defined within the wedge-shaped handle, the bearing comprising:

(a) a ball bearing race, carried within a groove defined in the handle;

(b) a collar, carried by the proximal end of the rope;

(c) a clinch fastener, carried by the rope, adjacent to, and proximal of, the collar, for preventing the rope from disengaging from the collar; and (d) a plurality of ball bearings, carried within the ball bearing race in contact with the collar, whereby rotation of the collar is facilitated by the ball bearings; and (E) a ball, attached to the distal end of the rope.

* * * * *